US006235202B1

(12) United States Patent
Ohkawa

(10) Patent No.: US 6,235,202 B1
(45) Date of Patent: May 22, 2001

(54) TANDEM PLASMA MASS FILTER

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/634,925

(22) Filed: Aug. 8, 2000

Related U.S. Application Data

(63) Continuation-in-part of application No. 09/464,518, filed on Dec. 15, 1999, and a continuation-in-part of application No. 09/192,945, filed on Nov. 16, 1998, now Pat. No. 6,096,220.

(51) Int. Cl.[7] ..... B03C 1/00

(52) U.S. Cl. ..... 210/695; 210/748; 210/222; 210/243; 209/12.1; 209/227; 96/2; 96/3; 95/28

(58) Field of Search ..... 210/695, 748, 210/222, 243, 223; 209/12.1, 227, 722; 96/1, 2, 3; 95/28

(56) References Cited

U.S. PATENT DOCUMENTS 3,722,677 3/1973 Lehnert .
5,039,312 8/1991 Hollis, Jr. .
5,350,454 9/1994 Ohkawa .
5,681,434 10/1997 Eastlund .
6,096,220 8/2000 Ohkawa .

*Primary Examiner*—David A. Reifsnyder
(74) *Attorney, Agent, or Firm*—Nydegger & Associates

(57) ABSTRACT

A tandem plasma mass filter for separating low-mass particles from high-mass particles in a multi-species plasma includes a cylindrical shaped wall which surrounds a hollow chamber. A magnet is mounted on the wall to generate a magnetic field that is aligned substantially parallel to the longitudinal axis of the chamber. Also, an electric field is generated which is substantially perpendicular to the magnetic field and which, together with the magnetic field, creates crossed magnetic and electric fields in the chamber. Importantly, the electric field has a positive potential on the axis relative to the wall which is usually zero potential. When a vapor is injected into the chamber and ionized, the resultant multi-species plasma interacts with the crossed magnetic and electric fields to eject high-mass particles into the wall surrounding the chamber. On the other hand, low-mass particles are confined in the chamber during their transit therethrough to separate the low-mass particles from the high-mass particles. The demarcation between high-mass particles and low-mass particles is a cut-off mass $M_c$ which is established by setting the magnitude of the magnetic field strength, $B_z$, the positive voltage along the longitudinal axis, $V_{ctr}$, and the radius of the cylindrical chamber, "a". pe1 $53M_c$ can then be determined with the expression: $M_c=ea^2(B_z)^2/8V_{ctr}$.

12 Claims, 2 Drawing Sheets

TANDEM PLASMA MASS FILTER

This is a continuation-in-part patent application of U.S. patent application Ser. No. 09/464,518, filed on Dec. 15, 1999, still pending which is a continuation-in-part patent application of U.S. patent application Ser. No. 09/192,945, filed on Nov. 16, 1998. Now U.S. Pat. No. 6,096,220. The contents of U.S. Pat. No. 6,096,220 are incorporated herein by reference.

FIELD OF THE INVENTION

The present invention pertains generally to devices and apparatus which are capable of separating charged particles in a plasma according to their respective masses. More particularly, the present invention pertains to energy efficient filtering devices which extract particles of a particular mass range from a multi-species plasma. The present invention is particularly, but not exclusively, useful as an energy efficient, high throughput filter for separating low-mass particles from high-mass particles.

BACKGROUND OF THE INVENTION

The general principles of operation for a plasma centrifuge are well known and well understood. In short, a plasma centrifuge generates forces on charged particles which will cause the particles to separate from each other according to their mass. More specifically, a plasma centrifuge relies on the effect crossed electric and magnetic fields have on charged particles. As is known, crossed electric and magnetic fields will cause charged particles in a plasma to move through the centrifuge on respective helical paths around a centrally oriented longitudinal axis. As the charged particles transit the centrifuge under the influence of these crossed electric and magnetic fields they are, of course, subject to various forces. Specifically, in the radial direction, i.e. a direction perpendicular to the axis of particle rotation in the centrifuge, these forces are: 1) a centrifugal force, $F_c$, which is caused by the motion of the particle; 2) an electric force, $F_E$, which is exerted on the particle by the electric field, $E_r$; and 3) a magnetic force, $F_B$, which is exerted on the particle by the magnetic field, $B_z$. Mathematically, each of these forces are respectively expressed as:

$$F_c = Mr\omega^2;$$

$$F_E = eE_r;$$

and $$F_B = er\omega B_z.$$

Where:

M is the mass of the particle;

r is the distance of the particle from its axis of rotation;

ω is the angular frequency of the particle;

e is the electric charge of the particle;

E is the electric field strength; and $B_z$ is the magnetic flux density of the field.

In a plasma centrifuge, it is universally accepted that the electric field will be directed radially inward. Stated differently, there is an increase in positive voltage with increased distance from the axis of rotation in the centrifuge. Under these conditions, the electric force $F_E$ will oppose the centrifugal force $F_c$ acting on the particle, and depending on the direction of rotation, the magnetic force either opposes or aids the outward centrifugal force. Accordingly, an equilibrium condition in a radial direction of the centrifuge can be expressed as:

$$\Sigma F_r = 0 \text{ (positive direction radially outward)}$$

$$F_c - F_E - F_B = 0$$

$$Mr\omega^2 - eE_r - er\omega B_z = 0 \qquad \text{(Eq. 1)}$$

It is noted that Eq. 1 has two real solutions, one positive and one negative, namely:

$$\omega = \Omega/2\left(1 \pm \sqrt{1 + 4E_r/(rB_z\Omega)}\right)$$

$$\text{where } \Omega = eB_z/M.$$

For a plasma centrifuge, the intent is to seek an equilibrium to create conditions in the centrifuge which allow the centrifugal forces, $F_c$, to separate the particles from each other according to their mass. This happens because the centrifugal forces differ from particle to particle, according to the mass (M) of the particular particle. Thus, particles of heavier mass experience greater $F_c$ and move more toward the outside edge of the centrifuge than do the lighter mass particles which experience smaller centrifugal forces. The result is a distribution of lighter to heavier particles in a direction outward from the mutual axis of rotation. As is well known, however, a plasma centrifuge will not completely separate all of the particles in the aforementioned manner.

As indicated above in connection with Eq. 1, a force balance can be achieved for all conditions when the electric field E is chosen to confine ions, and ions exhibit confined orbits. In the plasma filter of the present invention, unlike a centrifuge, the electric field is chosen with the opposite sign to extract ions. The result is that ions of mass greater than a cut-off value, $M_c$, are on unconfined orbits. The cut-off mass, $M_c$, can be selected by adjusting the strength of the electric and magnetic fields. The basic features of the plasma filter can be described using the Hamiltonian formalism.

The total energy (potential plus kinetic) is a constant of the motion and is expressed by the Hamiltonian operator:

$$H = e\Phi + (P_R^2 + P_z^2)/(2M) + (P_\theta - e\Psi)^2/(2Mr^2)$$

where $P_R = MV_R$, $P_\theta = MrV_\theta + e\Psi$, and $P_z = MV_z$ are the respective components of the momentum and eΦ is the potential energy. $\Psi = r^2B_z/2$ is related to the magnetic flux function and $\Phi = \alpha\Psi + V_{ctr}$ is the electric potential. $E = -\nabla\Phi$ is the electric field which is chosen to be greater than zero for the filter case of interest. We can rewrite the Hamiltonian:

$$H = e\alpha r^2B_z/2 + eV_{ctr} + (P_R^2 + P_z^2)/(2M) + (P_\theta - er^2B_z/2)^2/(2Mr^2)$$

We assume that the parameters are not changing along the z axis, so both $P_z$ and $P_\theta$ are constants of the motion. Expanding and regrouping to put all of the constant terms on the left hand side gives:

$$H - eV_{ctr} - P_z^2/(2M) + P_\theta\Omega/2 = P_R^2/(2M) + (P_\theta^2/(2Mr^2) + (M\Omega r^2/2)(\Omega/4 + \alpha)$$

where Ω=eB/M.

The last term is proportional to $r^2$, so if $\Omega/4+\alpha<0$ then, since the second term decreases as $1/r^2$, $P_R^2$ must increase to keep the left-hand side constant as the particle moves out in radius. This leads to unconfined orbits for masses greater than the cut-off mass given by:

$$M_c = e(B_z a)^2/(8V_{ctr}) \text{ where we used:}$$

$$\alpha=(\Phi-V_{ctr})/\Psi=-2V_{ctr}/(a^2B_z) \quad \text{(Eq. 2)}$$

and where a is the radius of the chamber.

So, for example, normalizing to the proton mass, $M_p$, we can rewrite Eq. 2 to give the voltage required to put higher masses on loss orbits:

$$V_{ctr}>1.2\times10^{-1}(a(m)B(\text{gauss}))^2/(M_c/M_p)$$

Hence, a device radius of 1 m, a cutoff mass ratio of 100, and a magnetic field of 200 gauss require a voltage of 48 volts.

The same result for the cut-off mass can be obtained by looking at the simple force balance equation given by:

$$\Sigma F_r=0 \text{ (positive direction radially outward)}$$

$$F_c+F_E+F_B=0$$

$$Mr\omega^2+eEr-er\omega B_z=0 \quad \text{(Eq. 3)}$$

which differs from Eq. 1 only by the sign of the electric field and has the solutions:

$$\omega=\Omega/2\left(1\pm\sqrt{1-4E/(rB_z\Omega)}\right)$$

so if $4E/rB_z\Omega>1$ then $\omega$ has imaginary roots and the force balance cannot be achieved. For a filter device with a cylinder radius "a", a central voltage, $V_{ctr}$, and zero voltage on the wall, the same expression for the cut-off mass is found to be:

$$M_c=ea^2B_z^2/8V_{ctr} \quad \text{(Eq. 4)}$$

When the mass M of a charged particle is greater than the threshold value ($M>M_c$), the particle will continue to move radially outwardly until it strikes the wall, whereas the lighter mass particles will be contained and can be collected at the exit of the device. The higher mass particles can also be recovered from the walls using various approaches.

It is important to note that for a given device the value for $M_c$ in equation 3 is determined by the magnitude of the magnetic field, $B_z$, and the voltage at the center of the chamber (i.e. along the longitudinal axis), $V_{ctr}$. These two variables are design considerations and can be controlled. It is also important that the filtering conditions (Eqs. 2 and 3) are not dependent on boundary conditions. Specifically, the velocity and location where each particle of a multi-species plasma enters the chamber does not affect the ability of the crossed electric and magnetic fields to eject high-mass particles ($M>M_c$) while confining low-mass particles ($M<M_c$) to orbits which remain within the distance "a" from the axis of rotation.

In all processes which create and then manipulate a plasma, a large amount of energy is required. Specifically, energy is required to vaporize and ionize the plasma material. On top of this, additional energy is required to create the magnetic and electrical fields that are needed to contain and manipulate the plasma. Consequently, the economic feasibility of using a plasma process such as a plasma mass filter or plasma centrifuge to separate one material from another depends significantly on energy considerations. Further, the throughput rate and separation efficiency also effect the energy input that is required to operate a plasma process.

In plasma processes such as a plasma mass filter, particles tend to travel along magnetic field lines in either direction. Consequently, for particles introduced into a magnetic field, approximately half of the particles travel in one direction along the magnetic field lines while the rest of the particles travel in the opposite direction, along the magnetic field lines. For a cylindrical vessel having magnetic field lines that are parallel to the cylinder's axis, wherein particles are introduced at one end of the vessel, only approximately half of the particles will travel toward the second end. The other half of the particles will collect in the vessel at the point of introduction. Consequently, for a plasma mass filter having a simple cylinder configuration, only about half of the material introduced at one end will effectively travel towards the exit at the opposite end and thereby undergo separation. A consequence of this is that about half of the material will need to be reprocessed.

In light of the above, it is an object of the present invention to provide a plasma mass filter for separation of low-mass particles from high-mass particles that is configured to increase energy efficiency, throughput rate and separation efficiency. It is another object of the present invention to provide a plasma mass filter having twice the throughput as a simple cylindrical plasma mass filter by introducing vapors into a magnetic field, perpendicular to the magnetic field lines, and to then allow half of the plasma that is generated in the filter to travel along the magnetic field lines in a first direction toward a first collector and the remaining plasma to travel in the opposite direction toward a second collector. It is another object of the present invention to provide a plasma mass filter for separating low-mass particles from high-mass particles that prevents a substantial amount of the particles from exiting the vessel at the point of introduction. Yet another object of the present invention is to provide a plasma mass filter which is easy to use, relatively simple to manufacture, and comparatively cost effective.

SUMMARY OF THE PREFERRED EMBODIMENTS

A plasma mass filter for separating low-mass particles from high-mass particles in a multi-species plasma includes a cylindrical shaped wall which surrounds a hollow chamber and defines a longitudinal axis. Around the outside of the chamber is a magnetic coil which generates a magnetic field, $B_z$. This magnetic field is established in the chamber and is aligned substantially parallel to the longitudinal axis. Also, at one end of the chamber there is a series of voltage control rings which generate an electric field, $E_r$, that is directed radially outward and is oriented substantially perpendicular to the magnetic field. With these respective orientations, $B_z$ and $E_r$ create crossed magnetic and electric fields. Importantly, the electric field has a positive potential on the longitudinal axis, $V_{ctr}$, and a substantially zero potential at the wall of the chamber.

In operation, the magnitude of the magnetic field, $B_z$, and the magnitude of the positive potential, $V_{ctr}$, along the longitudinal axis of the chamber are set. A rotating multi-species plasma can then be injected into one end of the chamber to interact with the crossed magnetic and electric fields. Alternatively, a material in the vapor state can be injected into the chamber through an inlet that is positioned substantially midway between the cylinder ends. Once injected into the chamber, the vapor can then be ionized to create a multi-species plasma by exposing the vapor to radiofrequency (rf) energy. A radiofrequency antenna can be mounted to the cylindrical wall inside the chamber to create the radiofrequency energy required to ionize the vapor. Once ionized, the pressure gradient that develops within the plasma will cause the ionized particles to travel along the magnetic field lines towards the cylinder ends. As described in detail below, low-mass particles will exit the cylinder at each cylinder end and high-mass particles will strike and be captured by the cylinder wall. More specifically, for a chamber having a distance "a" between the longitudinal axis and the chamber wall, $B_z$ and $V_{ctr}$ are set and $M_c$ is determined by the expression:

$$M_c = ea^2(B_z)^2/8V_{ctr}$$

Consequently, of all the particles in the multi-species plasma, low-mass particles which have a mass less than the cut-off mass $M_c$ ($M<M_c$) will be confined in the chamber during their transit through the chamber. On the other hand, high-mass particles which have a mass that is greater than the cut-off mass ($M>M_c$) will be ejected into the wall of the chamber and, therefore, will not transit the chamber.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
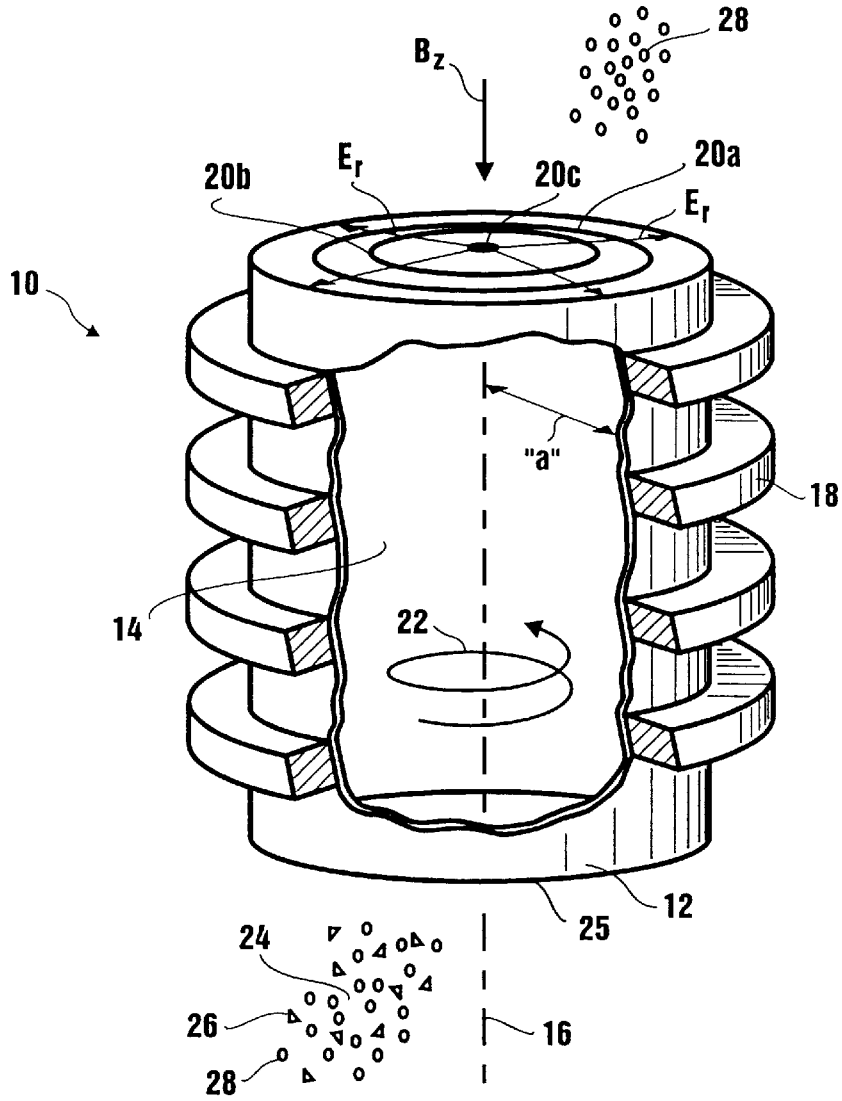
FIG. 1 is a perspective view of a plasma mass filter with portions broken away for clarity.

Referring to FIG. 1, a plasma mass filter is shown and generally designated 10. As shown, the filter 10 includes a substantially cylindrical shaped wall 12 which surrounds a chamber 14, and defines a longitudinal axis 16. The actual dimensions of the chamber 14 are somewhat, but not entirely, a matter of design choice. Importantly, the radial distance "a" between the longitudinal axis 16 and the wall 12 is a parameter which will affect the operation of the filter 10, and as clearly indicated elsewhere herein, must be taken into account.

Figure 2:
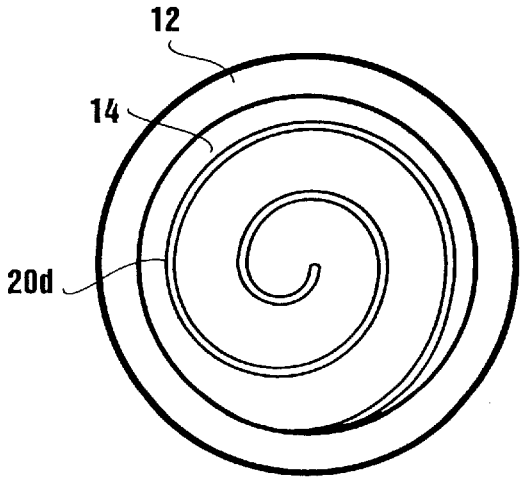
FIG. 2 is a top plan view of an embodiment for voltage control rings.

It is also shown in FIG. 1 that the filter 10 includes a plurality of magnetic coils 18 which are mounted on the outer surface of the wall 12 to surround the chamber 14. In a manner well known in the pertinent art, the coils 18 can be activated to create a magnetic field in the chamber 14 which has a component $B_z$ that is directed substantially along the longitudinal axis 16. Additionally, the filter 10 includes a plurality of voltage control rings 20, of which the voltage rings 20*a–c* are representative. As shown these voltage control rings 20*a–c* are located at one end of the cylindrical shaped wall 12 and lie generally in a plane that is substantially perpendicular to the longitudinal axis 16. With this combination, a radially oriented electric field, $E_r$, can be generated. An alternate arrangement for the voltage control is the spiral electrode 20*d* shown in FIG. 2.

For the plasma mass filter 10, the magnetic field $B_z$ and the electric field $E_r$ are specifically oriented to create crossed electric and magnetic fields. As is well known to the skilled artisan, crossed electric and magnetic fields cause charged particles (i.e. ions) to move on helical paths, such as the path 22 shown in FIG. 1. Indeed, it is well known that crossed electric and magnetic fields are widely used for plasma centrifuges. Quite unlike a plasma centrifuge, however, the plasma mass filter 10 for the present invention requires that the voltage along the longitudinal axis 16, $V_{ctr}$, be a positive voltage, compared to the voltage at the wall 12 which will normally be a zero voltage.

In the operation of the plasma mass filter 10, a rotating multi-species plasma 24 can be injected into one end 25 of the chamber 14, as shown in FIG. 1. Under the influence of the crossed electric and magnetic fields, charged particles confined in the plasma 24 will travel generally along helical paths around the longitudinal axis 16 similar to the path 22. More specifically, as shown in FIG. 1, the multi-species plasma 24 includes charged particles which differ from each other by mass. For purposes of disclosure, the plasma 24 includes at least two different kinds of charged particles, namely high-mass particles 26 and low-mass particles 28. It will happen, however, that only the low-mass particles 28 are actually able to transit through the chamber 14.

In accordance with mathematical calculations set forth above, the demarcation between low-mass particles 28 and high-mass particles 26 is a cut-off mass, $M_c$, which can be established by the expression:

$$M_c = ea^2(B_z)^2/8V_{ctr}.$$

In the above expression, e is the charge on an electron, a is the radius of the chamber 14, $B_z$ is the magnitude of the magnetic field, and $V_{ctr}$ is the positive voltage which is established along the longitudinal axis 16. Of these variables in the expression, e is a known constant. On the other hand, "a", $B_z$ and $V_{ctr}$ can all be specifically designed or established for the operation of plasma mass filter 10.

Due to the configuration of the crossed electric and magnetic fields and, importantly, the positive voltage $V_{ctr}$ along the longitudinal axis 16, the plasma mass filter 10 causes charged particles in the multi-species plasma 24 to behave differently as they transit the chamber 14. Specifically, charged high-mass particles 26 (i.e. $M>M_c$) are not able to transit the chamber 14 and, instead, they are ejected into the wall 12. On the other hand, charged low-mass particles 28 (i.e. $M<M_c$) are confined in the chamber 14 during their transit through the chamber 14. Thus, the low-mass particles 28 exit the chamber 14 and are, thereby, effectively separated from the high-mass particles 26.

Figure 3:
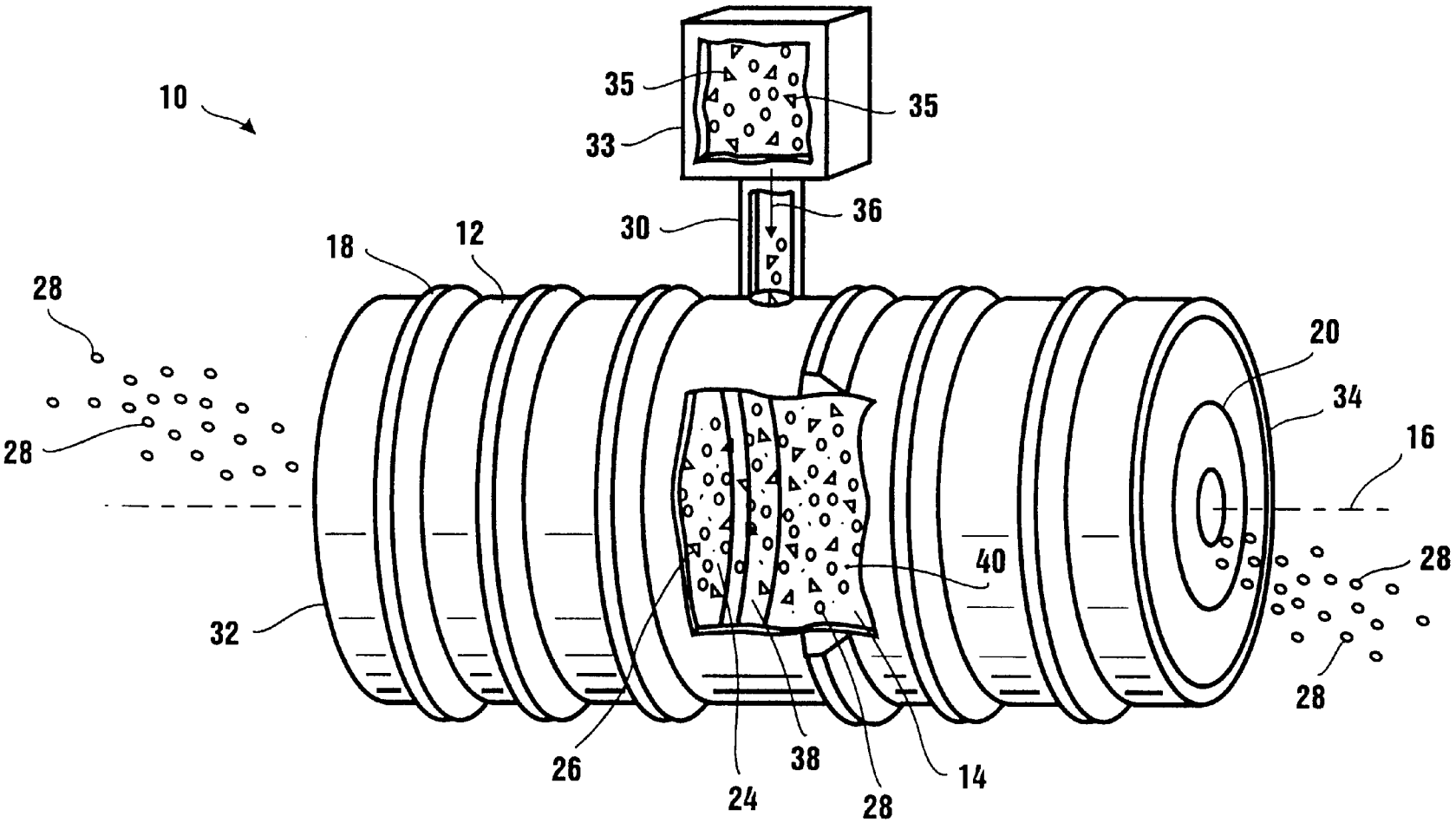
FIG. 3 is a perspective view of a tandem plasma mass filter with portions broken away for clarity.

FIG. 3 shows an embodiment of a plasma mass filter 10 in which the chamber 14 is formed with a chamber inlet 30 that is positioned substantially midway between the ends 32, 34 of the cylinder wall 12. An injector 33 can be used to inject a material in the vapor state (vapor 35) through the chamber inlet 30 in the direction of arrow 36 and into the chamber 14. For purposes of the present invention, any injector 33 known in the pertinent art can be used. Once injected into the chamber 14, the vapor 35 can be ionized to create a multi-species plasma 24 by exposing the vapor 35 to radiofrequency (rf) energy. As shown in FIG. 3, a radiofrequency antenna 38 can be mounted to the wall 12 inside the chamber 14 to create the radiofrequency energy that is required to ionize the vapor 35 into a multi-species plasma 24. As shown, the multi-species plasma 24 includes high-mass particles 26, low-mass particles 28 and electrons 40.

Once inside the chamber 14, a pressure gradient that develops within the multi-species plasma 24 will cause a portion of the multi-species plasma 24 to drift towards the end 32 while the remaining multi-species plasma 24 will drift in the opposite direction towards the end 34. As described above, the crossed electric and magnetic fields will cause the multi-species plasma 24 to travel in a generally helical path 22 about the longitudinal axis 16, as the plasma 24 drifts towards the ends 32, 34. In accordance with the mathematics set forth above, however, it will happen that only the low-mass particles 28 are actually able to transit through the chamber 14 and exit the chamber 14 through the two ends 32, 34. As discussed above, the high-mass particles 26 will travel on unconfined orbits. These unconfined orbits will cause the high-mass particles 26 to strike and be captured by the wall 12.

While the particular Tandem Plasma Mass Filter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A plasma mass filter for separating low-mass particles from high-mass particles which comprises:

a cylindrical shaped wall surrounding a chamber, said chamber defining a longitudinal axis, said cylindrical shaped wall having a first end and a second end and being formed with at least one chamber inlet positioned substantially midway therebetween;

means for generating a magnetic field in said chamber, said magnetic field being aligned substantially parallel to said longitudinal axis;

means for generating an electric field substantially perpendicular to said magnetic field to create crossed magnetic and electric fields, said electric field having a positive potential on said longitudinal axis and a substantially zero potential on said wall;

means for injecting a vaporized material through said chamber inlet and into said chamber; and means for ionizing said vaporized material in said chamber to create a multi-species plasma in said chamber to interact with said crossed magnetic and electric fields for ejecting said high-mass particles into said wall and for confining said low-mass particles in said chamber during transit therethrough to separate said low-mass particles from said high-mass particles.

2. A filter as recited in claim 1 wherein "e" is the charge of the particle, wherein said wall is at a distance "a" from said longitudinal axis, wherein said magnetic field has a magnitude "$B_z$" in a direction along said longitudinal axis, wherein said positive potential on said longitudinal axis has a value "$V_{ctr}$", wherein said wall has a substantially zero potential, and wherein said low-mass particle has a mass less than $M_c$, where $$M_c=ea^2(B_z)^2/8V_{ctr}.$$

3. A filter as recited in claim 2 further comprising means for varying said magnitude ($B_z$) of said magnetic field.

4. A filter as recited in claim 2 further comprising means for varying said positive potential ($V_{ctr}$) of said electric field at said longitudinal axis.

5. A filter as recited in claim 1 wherein said means for generating said magnetic field is a magnetic coil mounted on said wall.

6. A filter as recited in claim 1 wherein said means for generating said electric filed is a series of conducting rings mounted on said longitudinal axis at one end of said chamber.

7. A filter as recited in claim 1 wherein said means for generating said electric field is a spiral electrode.

8. A filter as recited in claim 1 wherein said means for ionizing said vaporized material is a radiofrequency antenna disposed in said chamber.

9. A method for separating low-mass particles from high-mass particles which comprises the steps of:

surrounding a chamber with a cylindrical shaped wall, said chamber defining a longitudinal axis, said cylindrical shaped wall having a first end and a second end and being formed with at least one chamber inlet substantially midway therebetween;

generating a magnetic field in said chamber, said magnetic field being aligned substantially parallel to said longitudinal axis and generating an electric field substantially perpendicular to said magnetic field to create crossed magnetic and electric fields, said electric field having a positive potential on said longitudinal axis and a substantially zero potential on said wall;

injecting a vaporized material through said chamber inlet and into said chamber; and ionizing said vaporized material in said chamber to create a multi-species plasma in said chamber to interact with said crossed magnetic and electric fields for ejecting said high-mass particles into said wall and for confining said low-mass particles in said chamber during transit therethrough to separate said low-mass particles from said high-mass particles.

10. A method as recited in claim 9 wherein "e" is the charge of the particle, wherein said wall is at a distance "a" from said longitudinal axis, wherein said magnetic field has a magnitude "$B_z$" in a direction along said longitudinal axis, wherein said positive potential on said longitudinal axis has a value "$V_{ctr}$", wherein said wall has a substantially zero potential, and wherein said low-mass particle has a mass less than $M_c$, where $$M_c=ea^2(B^z)^2/8V_{ctr}.$$

11. A method as recited in claim 10 further comprising the step of varying said magnitude ($B_z$) of said magnetic field to alter $M_c$.

12. A method as recited in claim 10 further comprising the step of varying said positive potential ($V_{ctr}$) of said electric field at said longitudinal axis to alter $M_c$.

* * * * *

UNITED STATES PATENT AND TRADEMARK OFFICE

CERTIFICATE OF CORRECTION

PATENT NO. : 6,235,202 B1
DATED : May 22, 2001
INVENTOR(S) : Tihiro Ohkawa

It is certified that error appears in the above-identified patent and that said Letters Patent is hereby corrected as shown below:

Abstract,
Line 23, delete [pel 53]

Column 8,
Line 47, delete [$B^z$] and insert -- $B_z$ --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*